US005140821A

United States Patent [19]

Fauske

[11] Patent Number: 5,140,821

[45] Date of Patent: Aug. 25, 1992

[54] APPARATUS AND METHODS FOR THERMAL PROTECTION OF LIQUID CONTAINERS

[75] Inventor: Hans K. Fauske, Hinsdale, Ill.

[73] Assignee: Westinghouse Electric Corp., Pittsburgh, Pa.

[21] Appl. No.: 620,815

[22] Filed: Dec. 3, 1990

[51] Int. Cl.[5] ..... F17C 5/02

[52] U.S. Cl. ..... 62/45.1; 62/47.1; 220/746

[58] Field of Search ..... 62/45.1, 47.1; 220/85 VR, 85 VS, 746

[56] References Cited

U.S. PATENT DOCUMENTS

| | | | |
|---|---|---|---|
| 2,724,527 | 11/1955 | Cantacuzene | 220/85 VS X |
| 2,790,307 | 4/1957 | Ayers | 220/85 VS X |
| 3,425,234 | 2/1969 | Trepaud | 62/45.1 |
| 3,818,715 | 6/1974 | Scurlock | 62/45.1 |
| 3,910,302 | 10/1975 | Sudhir | 220/85 VS X |
| 3,919,855 | 11/1975 | Turner | 62/45.1 |
| 4,541,248 | 9/1985 | Andrepont et al. | 220/85 VS X |
| 4,593,529 | 6/1986 | Birochik | 220/85 VS X |
| 4,620,962 | 11/1986 | Brodbeck | 62/47.1 X |
| 4,741,881 | 5/1988 | Fauske | 62/45.1 |
| 4,852,761 | 8/1989 | Turner et al. | 220/85 VR |
| 5,038,571 | 8/1991 | Yokouchi et al. | 62/47.1 X |

OTHER PUBLICATIONS

Publication entitled "CheMitigation, The Complete Hazards Analysis Service".

*Primary Examiner*—Henry A. Bennet
*Assistant Examiner*—Christopher B. Kilner
*Attorney, Agent, or Firm*—D. C. Abeles

[57] ABSTRACT

Methods and apparatus are disclosed for taking advantage of a heat exchange relation between a liquid coolant and a protected liquid, whereby vaporization of the liquid coolant withdraws heat from the body of the protected liquid or an exterior heat source in order to prevent undue temperature rise within the body of the protected liquid.

21 Claims, 2 Drawing Sheets

APPARATUS AND METHODS FOR THERMAL PROTECTION OF LIQUID CONTAINERS

BACKGROUND OF THE INVENTION

The present invention relates generally to various apparatus and methods for protecting liquids within a container, such as a reaction vessel or a storage vessel, from the adverse effects of high temperature. Where the liquids contained in such vessels are exposed to undesirably high temperatures, the vessel may be damaged or explode, or its emergency venting system may be activated.

While safety venting systems such as safety valves, rupture disks, and other components may appear to provide some protection against adverse consequences. This is not the case where the liquid sought to be protected is toxic, for example. In such cases, simply venting its container and allowing spillage is sometimes just as undesirable as allowing the vessel to leak or burst. Even if the liquid sought to be protected is not toxic, it is still clearly desirable to protect against explosion or venting in the first instance rather than permitting venting as an emergency arises and then trying to reduce the impact of such emergency venting.

It is known that liquid vessels may be protected by active or passive safety systems: by "active" system is meant one which requires extrinsic support of some kind for its operation. By a "passive system" is meant one which does not require the functioning of auxiliary equipment, such as pumps, motors, or extrinsically operated relief valves, etc. Passive systems include those having rupture disks or means for transferring heat from the body of the liquid, for example, to a heat exchange area without the operation of pumps, motors, valves, or the like.

In this connection, certain embodiments of the present invention are an improvement to the passive systems disclosed in U.S. Pat. No. 4,741,881.

Referring again to the general nature of the present invention, various chemicals, particularly including liquid chemicals undergoing a reaction, or those in storage, may be extremely safe when held within certain temperature limits, and yet hold out a serious risk of injury or even death to personnel. Such materials also create risks of damage to equipment, and/or to the surrounding environment, this risk may arise if the liquid temperature is permitted to attain a certain level. These circumstances can be aggravated if the temperature of the vessel contents is increasing at a rapid rate. Consequently, there is a need for apparatus and methods to ensure that, even under unexpected circumstances, unintended temperature rise in contained liquids is prevented or minimized.

According to the invention, a protective fluid is used as a combination heat sink and portion of a heat transfer mechanism, and different forms of apparatus are provided so that, whether the protected fluid is self-heated or is heated from outside sources, protection will be automatically provided.

Thus, in the case of an protected liquid wherein the principal hazard is exposure to exterior high temperatures coming from outside the storage vessel, a protective liquid is arranged as a shroud or the equivalent in the sense of covering at least one surface, and preferably most or all exposed surfaces of the container. A liquid of this sort may in some cases act as a sacrificial liquid in the sense that heat transferred to it may be boiled away at a temperature below the danger point for the protected fluid.

In other instances, the principal source of high temperature is the interior of the protected fluid itself. In these instances, the apparatus is constructed and arranged so that upon temperature rise within the body of the protected liquid, an exterior liquid is caused to circulate and/or vaporize, and in so doing, is caused to withdraw heat from the interior of the protected liquid without permitting the temperature of the protected liquid to rise unduly. In all cases, the temperature of the coolant liquid is selected so as to circulate and, in most cases, boil, well below a given temperature at which the protected liquid would become dangerous. The circulation and/or boiling temperature of the coolant liquid may be referred to as a threshold temperature, i.e., temperature at which significant protective action begins. The danger temperature is a temperature at which the protected liquid becomes dangerous. Significant heat exchange and/or evaporation occurs between these temperatures.

Various apparatus are described in detail, including those having tanks which include bayonet tubes, cooling coils, and/or top and/or sidewall jacketing providing large surface area contact between the protected liquid and the liquid coolant.

In view of the failure of the prior art to furnish effective protective mechanisms for certain fluids which are dangerous at certain predetermined "danger" temperatures, particularly those wherein, for reasons of toxicity, for example, ordinary venting is dangerous or undesirable for use as a safety measure, it is an object of the invention to provide a storage or reaction vessel adapted to protect liquids which prevent serious safety hazards to personnel, equipment, and/or the environment against fire, explosion, or accidental discharge to the atmosphere.

It is also an object of the invention to provide one or more apparatus which are able to provide for absorption by a liquid coolant of heat which might undesirably raise the temperature of a protected liquid.

Another object of the invention is to provide an apparatus which positions a liquid coolant in heat exchange relation with a protected liquid in such a way that the coolant provides a significant heat storage and dissipation capacity in relation to the heat capacity of the protected liquid.

A further object of the invention is to provide a method of protecting liquids against undue temperature rise by exchanging heat which might cause a temperature rise in the protected liquid between the protected liquid and/or an exterior source and a liquid coolant which achieves cooling action by circulation and/or vaporization.

Another object of the invention is to provide various forms of retention apparatus for protective liquids, which apparatus is relatively easy to construct and can be fabricated at reasonable cost by known techniques.

Yet another object of the invention is to provide a series of containers for liquids, which containers have known advantages and characteristics in use, including the ability to reflux a coolant liquid kept in intimate heat exchange with the body of the protected liquid as a method of withdrawing heat from the mass of protected liquid.

Another object of the invention is to provide an apparatus which takes advantage of the ability of a liquid coolant to absorb heat by convection or vaporization by maintaining the coolant in intimate heat exchange relation with the heat source.

Still another object of the invention is to provide a protective apparatus which includes an inner storage chamber for a protected liquid, an outer chamber with some of its surfaces exposed to the atmosphere and its other surfaces in contact with the exposed surfaces of the protected liquid chamber, with at least the sidewall surfaces of the inner chamber being covered by a liquid coolant disposed in the outer chamber, means for venting vapor from the headspace in the outer chamber vessel, and means for establishing an intimate heat exchange relation between the anticipated source of heat and the liquid coolant.

A still further object of the invention is to provide a composite vessel arrangement for a protected liquid wherein a first, fluid tight chamber for a protected liquid is provided, wherein the first chamber has a major portion of its exterior surrounded by a liquid coolant having a vaporization temperature below a temperature at which the protected liquid presents a fire or explosion hazard, and conduit means providing for movement of the liquid coolant through the body of the protected liquid by convection to establish heat exchange between the coolant and the contents of the protected liquid tank, particularly wherein such means include helical coils or the like and/or bayonet tubes each having one end portion disposed within the body of liquid coolant and the other in the body of the protected liquid.

Another object of the invention is to provide a liquid protective system wherein a coolant chamber at least partially surrounds a chamber for a protected liquid, wherein the protected liquid chamber includes a rupture disk and an outlet terminating in a diffuser unit disposed below the upper surface of the liquid in the coolant chamber, with the coolant fluid being maintained in heat exchange relation with the protected liquid, and wherein vent means are provided to permit whatever coolant is vaporized by heat exchange to pass to the atmosphere outside the coolant tank, whereby additional protection is provided against discharge of the protected liquid to the atmosphere.

A still further object of the invention is to provide a composite vessel which includes a chamber for a protected liquid and a liquid coolant chamber having portions surrounding and in heat exchange relation with the walls of the protected liquid chamber, and wherein plural tubes are arranged with portions thereof lying in each chamber to provide a refluxing type of heat exchange action between the body of the protected liquid and the body of the coolant.

Yet another object of the invention is to provide an arrangement providing a first liquid coolant for a protected liquid, and a third liquid acting as a medium for heat exchange between the two other liquids.

The foregoing and other objects and advantages of the invention are achieved in practice by providing methods and apparatus taking advantage of a heat exchange relation between a liquid coolant and a protected liquid, whereby vaporization of the liquid coolant withdraws heat from the body of the protected liquid or an exterior heat source in order to prevent undue temperature rise within the body of the protected liquid. The invention also achieves its objects and advantages by providing liquid containers which include means for providing heat exchange contact and/or circulation between bodies of coolant liquids and protected liquids, respectively.

The exact manner in which the foregoing and other objects and advantages are achieved in practice will become more clearly apparent when reference is made to the following detailed description of the preferred embodiments of the invention set forth by way of example, and shown in the accompanying drawings, wherein like reference numbers indicate corresponding parts throughout.

DESCRIPTION OF THE PREFERRED EMBODIMENTS OF THE INVENTION

While the invention may be practiced in various ways, using different forms of apparatus, a detailed description will be given of several forms of apparatus and methods which utilize the principles of the invention and which are applicable to different kinds of liquids, including what may be generically termed a protected liquid and a liquid coolant or protective liquid.

Ordinarily, the protected liquid is one which, if discharged to the atmosphere, would be dangerous to personnel, the environment, and/or equipment. In some instances, a third liquid, sometime referred to as a refluxing liquid, may also be provided. In the latter connection, it will be understood that, in some instances, the liquid coolant may itself undergo some refluxing incidental to the heat exchange processes used in the practice of the invention.

Figure 1:
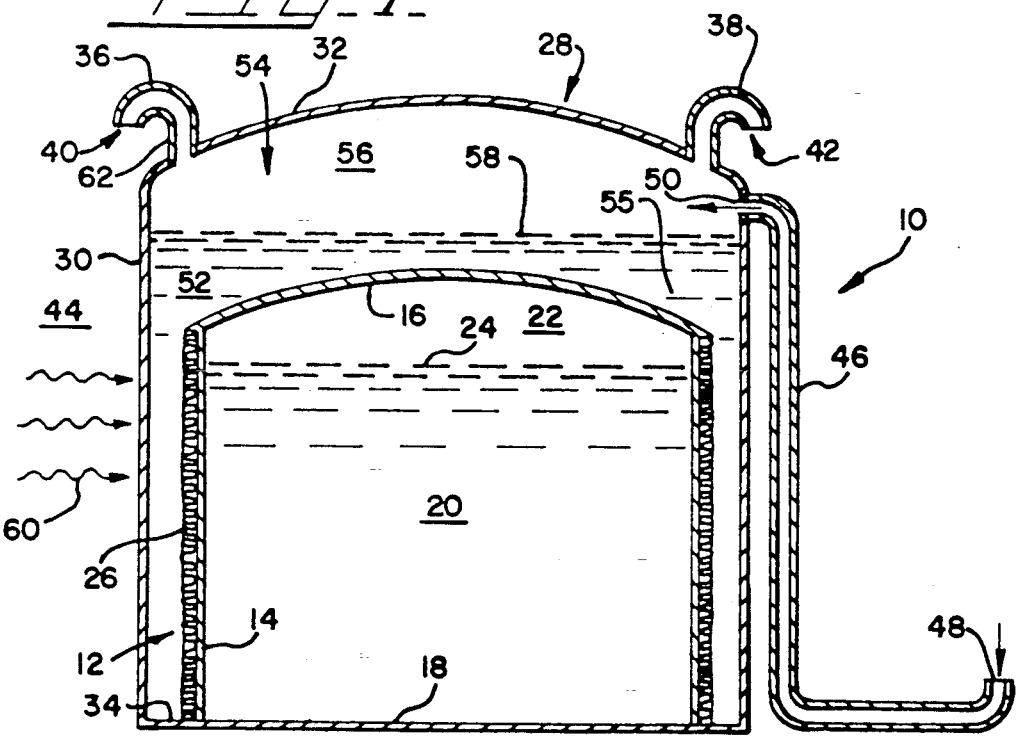
FIG. 1 is a vertical sectional view, partly diagrammatic in nature, and showing one arrangement of a composite vessel having vents and fill pipes arranged according to the invention, and showing a protected liquid disposed in an inner chamber container having a portion of its exterior surrounded by liquid coolant in a chamber with surfaces exposed to an external heat source.

Referring now to FIG. 1, there is shown a composite vessel, generally designated 10, which embodies the principles of the invention. As shown, the composite vessel 10 includes an inner chamber generally designated 12 and defined by side walls 14, a top wall portion 16 and a bottom wall 18. In the usual case, the bottom wall rests on the ground or on a floor which is in itself a significant heat barrier; this wall 18 is thus not considered to be exposed to exterior heat sources under normal conditions. A quantity of liquid 20 to be protected from the adverse effects of unduly high temperatures is disposed inside the inner chamber 12; a certain headspace 22 is preferably provided above the top surface 24 of the protected liquid 20. In the form shown, thermal insulation 26 covers the exterior of the inner vessel side wall 14.

Another part of the composite vessel 10 is formed by an exterior protective chamber generally designated 28, and this chamber is defined by exterior side walls 30, a top wall portion 32 and an annular bottom wall portion 34, which may be a continuation of the bottom wall 18 of the inner chamber 12. The exterior or protective chamber 28 is shown for purposes of illustration to include a pair of vent tubes 36, 38 each having open end portions 40, 42 respectively which communicate with the atmosphere 44 outside the vessel 10. In the preferred form of apparatus, a fill pipe 46 is provided; the pipe 46 has its inlet end 48 in communication with a source (not shown) of coolant and its outlet end 50 lying inside an upper portion of the outer chamber side wall 30. Introducing liquid coolant 52 into the interior portion generally designated 54 of the chamber 28 through the fill pipe 46, subdivides the chamber interior 54 into a subsurface portion 55 and a headspace portion 56 lying above the liquid surface 58. In the form illustrated, the composite vessel 10 is primarily intended to protect the liquid 20 in the interior of the container 12 from exterior heat source schematically shown by the arrows 60.

In keeping with a typical application of the inventive concept, it will be assumed that the liquid 20 is a liquid which is desirably protected against a high temperature (the "danger" temperature), at which temperatures an explosion hazard may be present, or at which one or more chemical reactions might occur which would create a runaway, rapidly pressure-increasing condition in the inner chamber 12. In this case, the exterior fluid 52 is selected so as to have a boiling point well below the danger point of the fluid 20. Such boiling point may be determined experimentally or may be known previously. In any case, as the temperature within the body of liquid coolant 52 in the outer chamber 28 increases, its vapor pressure will increase and ultimately, the liquid coolant 52 will begin to boil. This temperature is the "threshold" temperature, i.e., the temperature at which protective action becomes significant.

While the coolant 52 is absorbing the heat of vaporization needed to continue boiling, its temperature will not rise significantly above its boiling point, provided that the vents 40, 42 remain open to the atmosphere. The vapor concentration in the headspace 56 will increase, and under proper temperature conditions, a refluxing action may occur in the headspace. In the alternative, some or all of the vapor in the headspace 56 may simply escape to the outside atmosphere. The provision of the insulating layer 26 is made so that localized "hot spots" do not occur, as might be the case if the exterior temperature source 60 were in the form of a localized fire or the like.

In use, the interior chamber 12 of the composite vessel 10 is filled to a desired level from an appropriate exterior source, (not shown) of liquid to be protected; then, the interior of the protective vessel 28 is then filled by passing a liquid coolant 52 through its fill pipe 46 until a desired level is reached. Accordingly, even if significant volumes of liquid coolant 52 evaporate during the heat absorption process, as long as additional liquid coolant is supplied through the pipe 46, the temperature will not rise above the threshold or a set point temperature determined by the boiling point of the liquid 52, and if this temperature is appropriate, the contents 20 of the interior chamber 12 will remain at a safe temperature. FIG. 1 shows the coolant level to be such that its upper surface 58 lies above the top wall 16 of the inner chamber 12. This is preferred, but not strictly necessary, in that most heat transfers occur through sidewall surfaces in contact with the protected liquid and/or the heat source.

Figure 2:
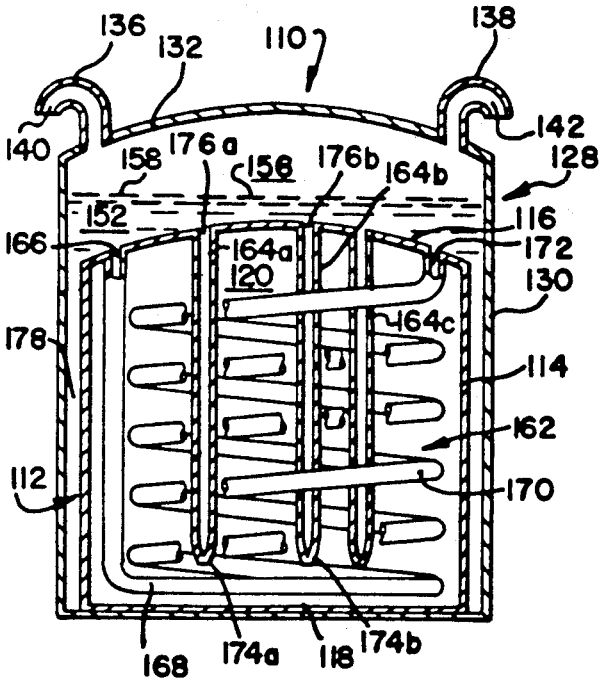
FIG. 2 is a vertical sectional view of one form of heat exchange apparatus of the invention, showing a vessel with an interior chamber, a vented exterior chamber containing a liquid coolant and showing conduits for achieving circulation of the liquid coolant within helical coils and bayonet tubes lying inside the protected liquid chamber.

FIG. 2 shows a composite vessel 110 which generally resembles that of FIG. 1 insofar as it includes an interior chamber generally designated 112 and is defined in part by side walls 114, a top wall 116, and a bottom wall 118. The vertical side wall 114 is spaced apart from a vertical side wall 130 forming a part of an exterior or protective chamber generally designated 128, and this chamber 128 includes vents 136, 138 which are similar to their counterparts in FIG. 1. Vent outlet openings 140, 142 provide communication to the atmosphere.

A supply of liquid coolant 152 is shown to be positioned such that its top surface 158 lies above the top wall 116 of the interior chamber 112. A provision may be made for fill pipes, etc. (not shown) for the introduction of protected liquid and coolant, it being understood that these may be similar to those shown in FIG. 1, or the other figures, if desired.

FIG. 2 also indicates that a closed end annular passage 178 is formed between spaced apart side walls 114, 130 for additional surface heat exchange, and convection currents occurring here will promote further heat exchange. In this regard, the embodiment of FIG. 2 resembles that of FIG. 1.

Referring now to a principal difference between the embodiment of FIG. 2 and that of FIG. 1, in FIG. 2, an additional heat exchange system is shown. This includes a conduit in the form of one helical coil, generally designated 162, and a plurality of bayonet tubes, **164*a*, 164*b*, 164*c* for example. This arrangement provides two separate means for permitting heat exchange between the coolant 152 and the body of the liquid in the inner chamber 112 of the composite vessel 110. In the form of apparatus shown, convection-induced flow of liquid coolant 152 will occur when there are temperature differences in the liquids 120, 152. Convective forces move coolant 152 into the tube inlet 166, down to a lowermost, generally horizontally extending portion 168 of the conduit system 162 and then up and through the inclined or helix portions 170 of the conduit to the conduit outlet 172**. Flow might also occur in an opposite direction.

The bayonet tubes **164*a*, 164*b*, 164*c*, etc. include closed lower end portions 174*a*, 174*b*, etc. The upper ends of these tubes 164*a*, 164*b*, etc. are open, as shown at 176*a*, 176*b***, etc., in this embodiment. Convection cooling will also be provided in these tubes where the liquids 120, 152 are of different temperatures. Accordingly, both the bayonet tubes 164a, etc. and the helical coil conduit system 162 provide inlet and outlet portions disposed in communication with the protective liquid 152; in the bayonet tubes, a common opening provides both the inlet and the outlet.

In use, assuming that the interior inner chamber 112 is going to be the source of heat desired to be dissipated or exchanged, and that the danger is thus that of internal heating, the arrangement permits coolant to circulate from the coolant supply in the outer chamber 128 throughout the body of the protected liquid, impelled by the convection currents just described.

The bayonet tubes also are capable of achieving circulation by convection, but these tubes operate most effectively where the boiling point of the coolant 152 is selected so as to be at or below the threshold temperature, i.e., well below the danger temperature of the interior or protected liquid.

As the boiling point of the liquid 152 is approached and reached, countercurrent flow will develop in the open ended bayonet tubes, i.e., liquid will pass vertically down the walls of the tubes and vapor will escape upward in or near the centers of the tubes.

Significant evaporation may also occur in the headspace 156 above the top surface 158 of the liquid, and if this vapor does not condense by contact with a cooler surface, such as the top surface 132 of the exterior chamber 128, these vapors will pass out of the vent openings 142 at a rate dictated by their vapor pressure, and coolant will simply continue to evaporate from the body 152 of coolant as it takes on additional heat.

In the use of the apparatus just described, the thermal mass of the exterior or protective liquid coolant is utilized with heat transfer mechanisms to provide protection against undue temperature rise by what is essentially a heat sink and heat absorption mechanism. The heat of vaporization of the coolant adds to the heat transfer potential in preventing undue rise of temperature within the interior chamber.

The bayonet tube arrangement and the helical tube arrangement are merely preferred, illustrative arrangements of heat exchange systems, not the only systems effective for this purpose. An incidental advantage of the exterior annular liquid jacket 178 formed between the side walls 114, 130 of the chambers is the provision of thermal insulation from whatever exterior heat threat may exist. In addition, the jacketing provides additional storage capacity for whatever liquid coolant may be needed considering appropriate safety factors. Of course, if the exterior temperature is low, the exterior sidewalls 130 provide additional heat exchange surfaces.

Figure 3:
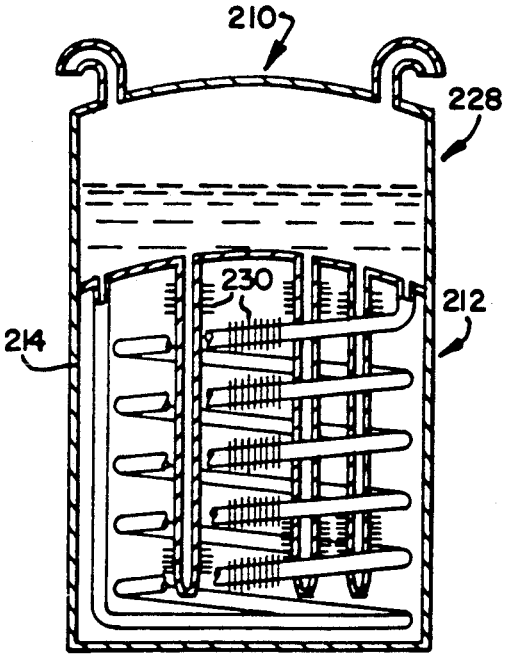
FIG. 3 is a vertical sectional view, partly diagrammatic in nature, of a form of apparatus similar to that of FIG. 2, but varying therefrom slightly in detail.

Referring now to FIG. 3, another arrangement for a protective composite vessel is shown, this one generally designated 210. This arrangement is identical to that of FIG. 2 except that a single cylindrical element 214 forms an exterior wall common to both the interior container 212 and the exterior container 228. The arrangements for heat exchange, coolant fluid storage, venting, and the like may be identical or very similar; an annular jacket for liquid coolant, such as the jacket 178 shown in FIG. 2, is not provided in this embodiment.

As is shown in FIG. 3, some or all of the conduits, either the helical coil tubes or the bayonet tubes, may include fins 230, contoured surfaces or the like to enlarge their effective surface area and thus increase the heat transfer rate between the coolant and the protected liquid.

Figure 4:
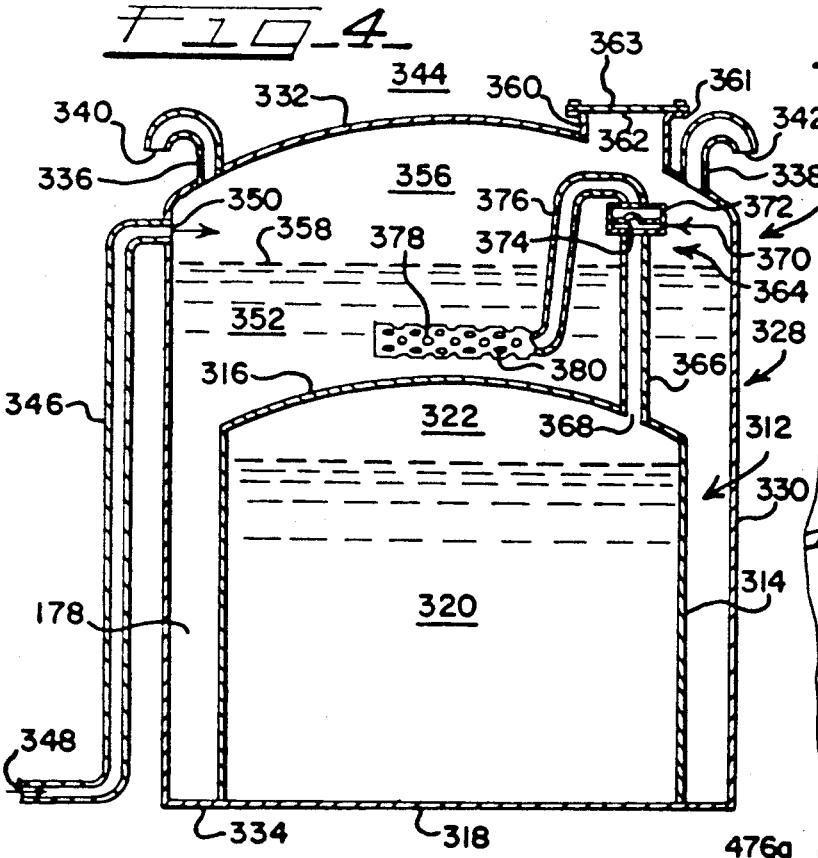
FIG. 4 is a vertical sectional view, partly diagrammatic in nature, showing a vessel with interior and exterior chambers, containing a protected liquid and a liquid coolant, respectively, and showing a vent tube, rupture disk and diffuser arrangement for the protected liquid and vents, a fill tube and an access port forming parts of the outer or liquid coolant chamber.

Referring now to FIG. 4, another composite vessel, generally designated 310, is shown to embody the invention. This unit 310 includes an interior chamber generally designated 312 and shown to include side walls 314, a top wall portion 316, and a bottom wall 318. A quantity of liquid 320 to be protected is disposed within the interior of the chamber 312. A headspace 322 of a desired height is provided to allow a certain degree of vaporization of the protected liquid 320, and to prevent significant rise of hydrostatic pressure created by thermal expansion.

An exterior chamber, generally designated 328, is defined by side walls 330, an annular bottom wall 334, and a top wall 332. Conduits 336, 338 each having open end portions 340, 342 respectively, serve as vents to the atmosphere 344 for the headspace 356 lying above the surface 358 of the liquid 352 in the outer chamber 328. A fill pipe 346 having an inlet 348 and an outlet 350 communicating with the outer tank interior is also provided. In the construction shown, a generally cylindrical, vertically extending wall 359 terminates in a flange 361 which defines an access port or manhole 362. A cover 363 may be removed from the flange 361 to gain access to the interior of the outer chamber 328.

Referring now to another feature of the construction of the apparatus of FIG. 4, a quencher arm/rupture disk system generally designated 364 is provided and is shown to include a vertically extending lower pressure relief vent tube 366 having its open lower end 368 communicating with the headspace 322 in the interior vessel 312. At the top of the tube 366 is a pressure relief vent assembly generally designated 370 and schematically shown to include a disk positioner 372 and a rupturable disk element 374. The construction and operation of these units is known to those skilled in the art.

Disposed above the pressure relief assembly 370 is a quencher arm in the form of a hollow tube 376 having one of its ends communicating with the interior of the vent tube closed off by the pressure relief assembly 370, and its other end being arranged in the form of a horizontally extending diffuser unit 378 having a plurality of small diameter spaced apart diffuser outlets 380.

In this embodiment, the relief vent/quencher arm assembly is arranged so that the relief vent assembly 370 is positioned above the surface 358 of the liquid coolant 352 while the diffuser portion of the quencher arm is located well beneath this surface. In this arrangement, a supplemental safety system is provided. If the pressure in the headspace 322 rises to a point equal to the set pressure of the rupture disk, some of the contents 320 of the interior chamber 312 will pass through the inner chamber vent tube 366 and the quencher arm 376, and then be directed into the subsurface area of the liquid coolant 352. Hence, vapor condensation occurs, and scrubbing, neutralization, and incidental heat absorption occurs. While heat generated by condensation of the vapors passing through the diffuser will serve to reduce heat buildup in the inner chamber 312, the heat load on the coolant 352 will increase. However, as long as the passages 340, 342 remain open, evaporative cooling of the protective liquid coolant 352 will continue to be effective to reduce, or minimize the increase in, temperature of the protected liquid 320. In keeping with the invention, if temperatures rise unduly and particularly if the rupture disk is pierced, additional coolant may be introduced through the fill pipe to provide additional heat absorption capacity.

Because the usual application of this form of apparatus is the isolation and protection of toxic liquids, the provision of scrubbing, neutralizing and/or condensing apparatus is very important in such application.

A preferred but not necessary feature of the invention provided in the embodiment of FIG. 4 is that the diffuser 378 is kept beneath the surface of the protective liquid 352 for the reasons just discussed, yet the rupture disk assembly 370 is maintained above the liquid level so that maintenance personnel entering through the manhole may replace the rupture disk periodically without undue inconvenience and without sacrificing the effectiveness of the protective cooling system.

Although not shown in FIG. 4, it should be understood that the pressure relief and quencher system of the apparatus of FIG. 4 may be combined with the bayonet tubes and/or convection operated heat exchange coils of the type shown in the embodiments of FIGS. 2 and 3, to obtain intimate heat exchange contact between the liquid in the inner chamber 314 and the body of coolant liquid 352. The jacketing area 378 may also provide additional coolant capacity and can significantly increase the heat exchange surface area presented to the exterior atmosphere 344.

Figure 5:
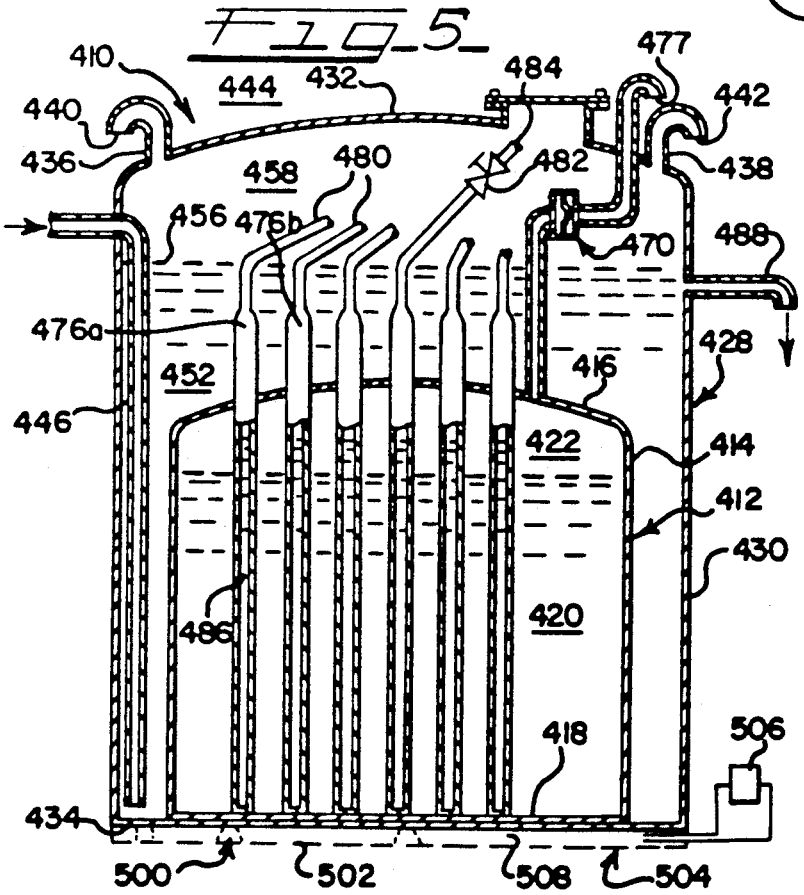
FIG. 5 is a vertical sectional view of a form of apparatus similar to FIG. 4, but shown additionally to include plural, liquid containing bayonet tubes having their lower end portions in heat exchange relation with the protected liquid and their upper end portions in heat exchange relation with the liquid coolant, whereby a refluxing action secures heat exchange between the two liquids, with the view also illustrating the provision and positioning of fill tubes, vents, a rupture disc, and an access port for one of the chambers; and, FIG. 6 is a greatly enlarged vertical sectional view, partly diagrammatic in nature, showing refluxing of a heat exchange liquid and countercurrent flow within a bayonet tube of the type shown in FIGS. 2, 3 and 5, for example.
Figure 5:
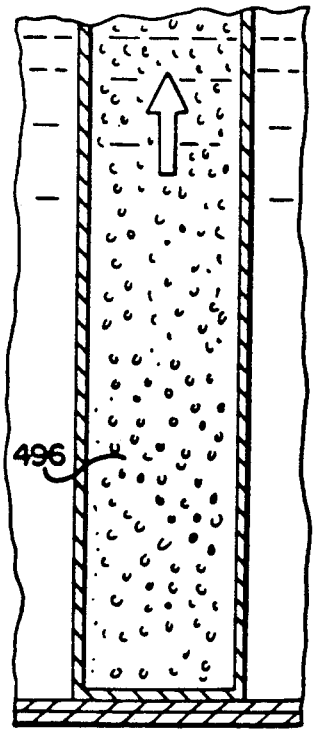

Referring now to FIG. 5, a still further form of composite vessel apparatus generally designated 410 is shown. This unit likewise includes an inner chamber generally designated 412 and defined by side walls 414, a top wall 416, and a bottom wall 418, serving to enclose a mass of protected liquid 420 in a region below the headspace 422 of the inner chamber 412. The chamber 412 is largely surrounded by an outer, coolant-containing chamber or jacket generally designated 428 and shown to include an exterior side wall 430, an exterior top wall 432, an annular bottom wall 434 and, a pair of exterior vent assemblies 436, 438 each including outlets 440, 442 to the atmosphere 444 exterior to the headspace 456 above the surface 458 of the body of liquid 452 in the outer chamber 428.

The form of apparatus shown in FIG. 5 differs from that shown in FIGS. 2 and 3 in one structurally important respect, and in two functionally important respects. In the apparatus of FIG. 5, a plurality of bayonet tubes 476*a*, 476*b*, etc. are provided. Each of these tubes, unlike the arrangement of FIGS. 2 and 3, however, includes a reduced diameter end portion 480 closed off by a refill valve assembly 482; the end 480 and the valve 482 lie above the surface 458 of the liquid 452 in the coolant chamber 428.

In this construction, the bayonet tubes 476*a*, *b*, etc. are filled with a third fluid, i.e., a fluid different from both the fluid 420 and the coolant 452. The fluid may be supplied or replenished from a source (not shown) which communicates with a supply line 484 lying on the side of the valve 482 opposite the tube section 480. The liquid chosen to reside in the interiors 486 of these bayonet tubes is preferably a liquid which has a boiling point at or near the threshold temperature of the protected liquid 420, but below the danger temperature at which the liquid coolant 452 exhibits a high vapor pressure. In other words, the bayonet tube or third liquid is the lowest boiling of the three.

The apparatus of FIG. 5 is also shown to include a fill tube 446 for supplying coolant 452 and a level-maintaining or coolant overflow tube 488. In addition, a rupture disk type pressure relief system generally designated 470 of the type shown in FIG. 4 may be provided.

In the form of apparatus shown in FIG. 5, it is anticipated that the temperature of the third fluid, which may be termed a heat exchange fluid, will have the temperature characteristics just referred to, and that such fluid may be placed in the interiors 486 of the tubes 476 at a level approximating the level of the protected fluid 420. Assuming that there is a significant temperature increase in the protected fluid 420, this will cause heat to be absorbed by the bayonet tubes and the heat exchange liquid will begin to vaporize. The tendency of the heat exchange fluid in the bayonet tubes to remain in the vapor state will be resisted by the condensing effect in the upper portions 489 of the tubes, i.e., the portions lying within the body of coolant 452. This will cause the condensation and lowering of temperature in the headspace of the tubes.

Figure 6:
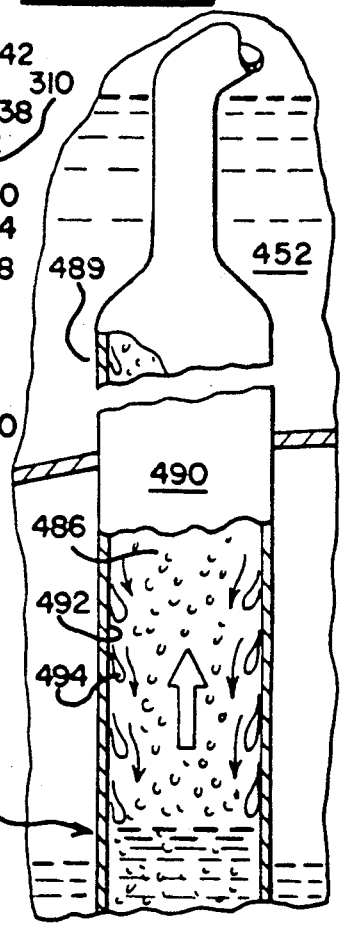

Referring now to FIG. 6, a schematic illustration of the operation of the bayonet tubes is shown. Here, the interior 486 of the bayonet tube is shown to be defined by interior walls 492 along which vapor droplets 494 are shown to be condensing. In the lower most portion 496 of the tube 476*a*, it is assumed that temperatures are slightly higher and that a largely vapor condition exists. As shown by the directional arrows, the center portion of the tube 476*a* is occupied by ascending vapor, and the inner portions 492 of the walls 490 are covered by condensed or condensing vapors. The greatest amount of this condensation occurs in the portion 489 of the tube lying within the body of the coolant 352. The reflux action generated by these bayonet tubes is sufficient to provide significant heat exchange capacity for the liquid 420.

Where conditions in the headspace 422 exceed anticipated design criteria, the protected liquid may require venting, and in this case, the pressure vent system 470 may be activated. In the form of apparatus shown in FIG. 5, the outlet 477 of the pressure vent system 470 is located in the atmosphere outside the outer chamber 428; however, the fluid might equally well be vented to the interior of the chamber 428, including a subsurface area thereof if desired. This would be achieved by providing the form of quencher arm and diffuser apparatus shown in FIG. 4, or its equivalent. This form would be used in the protection of products which are toxic and/or noxious to personnel, the environment, or equipment.

Referring again to FIG. 5, it will be understood that a helical tube or other form of convective circulation apparatus might be provided in a closed loop system such as that provided for by the bayonet tubes. In addition, a system of the types shown in FIGS. 2 or 3, providing for circulation of coolant from the outer chamber 428 might be provided for use in cooperation with the bayonet tubes. Thus, these features may be used singly or in combination.

Referring now to a still further, optional feature of construction of the vessel shown in FIG. 5, it will be noted that the lower surface 418 of the inner chamber and the lower surface 434 of the outer chamber may be positioned on support means generally designated 500 such as ribs or the like generally designated 500 to space these walls apart from an exterior tank floor 502. One or more probes generally designated 504 may be used in association with a remote sensing instrument 506 in this area for detecting leakage from the inner tank. The area 508 between the two tanks may also serve as a collection area for leakage as a further safety factor if this desired.

According to the invention, one of the reasons for providing the overflow or leveling pipe 488 is for use in supplying coolant to a pump for recirculation, or for supplying specimens of coolant to leak detection instrumentation, for example. It may be desired to circulate coolant from a larger exterior source into the outer chamber 428, or to supplement the coolant conditions wherein coolant temperature is rising. A fresh supply of reduced temperature coolant might be supplied in relatively large quantities by this means, and this alternate construction would be of importance where the extra heat capacity provided by such additional supply of coolant would be required only rarely but would nevertheless be available for occasional use.

According to the invention, a number of forms of apparatus are provided for protection of liquid systems, either those wherein fluid is being stored or those wherein reactions are taking pace. The systems described are passive and hence are not susceptible to failure unless the apparatus is somehow itself physically destroyed or damaged. The use of appropriate instrumentation might be employed in connection with adding safety measures, but is not normally required in the use of the invention. The selection of the coolant fluid may be done by existing criteria. If for example, in the form of apparatus shown in FIG. 4, a protected liquid had required neutralization or other scrubbing before possible atmospheric discharge, the subsurface quencher/diffuser arm construction could be used. Where there is a significant temperature difference between the boiling point of the coolant and that of the protected liquid, the bayonet tube form of protection is useful. Needless to say the sizes of the chambers relative to each other can be determined by applying appropriate safety factors and by making other calculations known to those skilled in the art.

It has also been pointed out that a preferred form of apparatus may combine one or more of the heat exchange/heat absorption methods or elements into a single form of apparatus.

Various preferred embodiments of the invention having been described by way of example, it is understood that changes to these preferred forms may occur to those skilled in the art, and it is understood that such changes or variations may be made without departing from the spirit of the invention or the scope of the appended claims.

I claim:

1. An apparatus for protecting a liquid against dangers created by the rise of temperatures substantially beyond a given temperature at which said liquid becomes hazardous, said apparatus comprising a composite vessel having inner and outer, liquid-containing chambers, a protected liquid whose temperature is sought to be controlled being disposed in said inner chamber and a liquid coolant disposed in said outer chamber for providing the capacity for absorbing heat emanating from a heat source having the potential to raise the temperature of said protected liquid to and beyond said given temperature, means associated with a lower portion of at least one of said chambers for sounding an alarm in the event of leakage of liquid from at least one of said inner and outer chambers, said inner chamber having bottom, top and side wall portions and said outer chamber also including bottom, top and side wall portions, with at least one each of said surfaces defining said inner and outer chambers being heat exchange surfaces providing intimate heat exchange contact with each other to provide heat transfer between said protected liquid and said liquid coolant, with said outer chamber also including at least one means for venting vapor in the interior of said outer chamber to the atmosphere outside said outer chamber, said liquid coolant in said outer chamber being normally disposed at a level above the liquid level in said inner chamber, with the vapor pressure and boiling point of said liquid coolant being related to said given temperature such that heat tending to raise said protected liquid to said given temperature may be primarily absorbed by evaporation of said liquid coolant at a temperature below said given temperature at which said protected liquid becomes hazardous.

2. An apparatus as defined in claim 1 wherein said inner and outer chambers have their respective side walls spaced apart in opposed facing relation so as to define a liquid coolant jacket between said opposed side walls, and wherein said heat exchange surfaces include a common wall forming a portion of said inner and outer chamber side walls.

3. An apparatus as defined in claim 1 wherein said heat source is exterior to said outer chamber, and wherein at least said side wall portions of said inner chamber include thermal insulation associated therewith, whereby the rate at which heat from said heat source is absorbed by said protected liquid in relation to the rate at which said heat is absorbed by said liquid coolant is minimized.

4. An apparatus as defined in claim 1 wherein said source of heat comprises a source exterior to both said inner and outer chambers of said composite vessel.

5. An apparatus as defined in claim 1 wherein said at least one venting means comprises at least two vents.

6. An apparatus as defined in claim 1 wherein means are additionally provided in said outer chamber for introducing liquid coolant into said outer chamber from a remote location exterior to said outer chamber.

7. An apparatus as defined in claim 1 wherein said inner chamber includes a plurality of bayonet tubes extending from at least one wall of said inner chamber to the interior of said inner chamber, with the wall surfaces of said bayonet tubes thereby providing additional heat exchange surfaces.

8. An apparatus as defined in claim 1 wherein said inner chamber further includes at least one liquid coolant conduit disposed within the interior of said chamber, said liquid coolant conduit including spaced apart liquid inlets and outlets communicating with the interior of said outer chamber, with the length of said conduit being at least twice the height of said inner chamber, with the wall surfaces of said conduit thereby providing additional heat exchange surfaces.

9. An apparatus as defined in claim 8 wherein said liquid coolant conduit comprises a continuous tube arranged in a helical configuration.

10. An apparatus as defined in claim 1 wherein said inner and outer chambers share a single, circumferentially continuous outer side wall, said outer side wall of said inner chamber being a lower portion of said side wall and the side wall surface of sad outer chamber being an upper portion of said side wall.

11. A composite safety container for volatile liquids, said safety container including a first vessel receiving in use a predetermined level of a liquid to be protected against attaining a temperature level in excess of a given temperature, a second vessel having wall portions surrounding said first vessel, and means for containing liquid coolant at a level such that, in use, the upper surface of said coolant lies above the uppermost surface of the major portion of said first vessel, and at least one vent extending from the interior of said second vessel to the atmosphere lying outside said second vessel and a heat exchange system comprising at least one heat exchange fluid receiver with a lower portion thereof extending into said first vessel and lying beneath the level of the protected liquid therein and an upper portion lying at least in part beneath the surface of the liquid in said second vessel, said heat exchange fluid receiver having means for adding fluid to or exhausting fluid from said receiver without removing said receiver from said first vessel, said means for adding fluid to or exhausting fluid from said receiver including a valve unit for said receiver, which valve unit may be manipulated from above the level of said coolant in said second vessel, said heat exchange fluid receiver having disposed therein a heat exchange liquid having a boiling point below said given temperature of said protected liquid, and also below the temperature of said liquid coolant, whereby, as the temperature in said protected liquid rises, said heat exchange liquid undergoes an evaporation and condensation cycle within said fluid receiver, evaporating where said liquid is in intimate heat exchange contact with said protected liquid, and condensing where said liquid is in intimate heat exchange relation with said liquid coolant.

12. A composite safety container as defined in claim 11 wherein said liquid coolant is a higher boiling point liquid than said protected liquid.

13. A composite safety container as defined in claim 11 wherein said at least one heat exchange fluid receiver comprises a plurality of heat exchange fluid receivers.

14. An apparatus for protecting a liquid against dangers created by the rise of temperatures substantially beyond a given temperature at which said liquid becomes hazardous, said apparatus comprising a composite vessel having first and second, liquid-containing chambers, a protected liquid whose temperature is sought to be controlled being disposed in said first chamber, a liquid coolant disposed in said second chamber for providing the capacity for absorbing heat emanating from a heat source having the potential to raise the temperature of said protected liquid to and beyond said given temperature, said first chamber having bottom, top and side wall portions and said second chamber also including bottom, top and side wall portions, with at least one each of said surfaces defining said first and second chambers being heat exchange surfaces providing intimate heat exchange contact with each other to provide heat transfer between said protected liquid and said liquid coolant, with said second chamber also including at least one means for venting vapor in the interior of said second chamber to the atmosphere outside said second chamber, said liquid coolant in said second chamber being normally disposed at a level above the liquid level in said first chamber, with the vapor pressure and boiling point of said liquid coolant being related to said given temperature such that heat tending to raise said protected liquid to said given temperature may be primarily absorbed by evaporation of said liquid coolant at a temperature below said given temperature at which said protected liquid becomes hazardous, and means forming a path of communication from the interior of said first chamber to an area outside said second chamber, and means normally closing said path of communication but responsive to a given pressure level in said first vessel to open said flow path, whereby excessive pressure in said first chamber may cause said means to open and the contents of said first vessel to be vented to the atmosphere outside said second container.

15. A composite safety container as defined in claim 14 wherein said responsive means comprises a rupture disk.

16. A composite safety container as defined in claim 14 which further includes means for supplying liquid coolant to said second vessel from a position exterior to said second vessel.

17. An apparatus for protecting a liquid against dangers created by the rise of temperatures substantially beyond a given temperature at which said liquid becomes hazardous, said apparatus comprising a composite vessel having inner and outer, liquid-containing chambers, a protected liquid whose temperature is sought to be controlled being disposed in said inner chamber, and a liquid coolant disposed in said outer chamber for providing the capacity for absorbing heat emanating from a heat source having the potential to raise the temperature of said protected liquid to and beyond said given temperature, said inner chamber having bottom, top and side wall portions and said outer chamber also including bottom, top and side wall portions with at least a portion of each of said sidewall surfaces defining said inner and outer chambers being disposed in spaced apart, facing relation to each other to define therebetween a liquid coolant jacket surrounding said inner chamber sidewall surface, with said outer chamber also including at least one vent to permit venting of vapor from the interior of said outer chamber to the atmosphere outside said outer chamber, said liquid coolant in said outer chamber being disposed at a level above the top wall surface of said inner chamber, said inner chamber also including a vent system having a vent pipe extending upwardly from said inner chamber top wall and a quencher arm extending from said vent pipe and terminating in a diffuser unit disposed beneath the upper surface of said liquid coolant, and means in said vent pipe for controlling the flow of fluid within said vent pipe in response to the pressure in said inner chamber, with the vapor pressure and boiling point of said liquid coolant being related to said given temperature such that heat tending to raise said protected liquid to said given temperature may be primarily absorbed by evaporation of said liquid coolant at a temperature below said given temperature at which said protected liquid becomes hazardous.

18. An apparatus as defined in claim 17 which further includes pressure responsive relief valve between said vent pipe and said quencher arm.

19. An apparatus as defined in claim 18 wherein said outer chamber includes means permitting entry by a worker for inspection and/or maintenance of said relief valve.

20. An apparatus for protecting a liquid against dangers created by the rise of temperatures substantially beyond a given temperature at which said liquid becomes hazardous, said apparatus comprising a composite vessel having inner and outer, liquid-containing chambers, a protected liquid whose temperature is sought to be controlled being disposed in said inner chamber and a liquid coolant disposed in said outer chamber for providing the capacity for absorbing heat emanating from a heat source having the potential to raise the temperature of said protected liquid to and beyond said given temperature, said inner chamber having bottom, top and side wall portions and said outer chamber also including bottom, top and side wall portions with at least one portion of each of said side walls being spaced apart in opposed facing relation to define therebetween a jacket for said liquid coolant, with said outer chamber also including at least one vent for permitting vapor to pass from the interior of sad outer chamber to the atmosphere outside said outer chamber, said liquid coolant in said outer chamber being disposed at a level above the liquid level in said inner chamber, said inner chamber including a plurality of bayonet tubes having their body portions extending into the interior of said inner chamber and their open end portions in communication with said liquid coolant, and at least one liquid conduit in tubular coil form extending into said inner chamber interior and having its ends open to receive and discharge liquid coolant flowing therethrough during heat exchange between said coolant and said protected liquid, with the vapor pressure and boiling point of said liquid coolant being related to said given temperature such that heat tending to raise said protected liquid to said given temperature may be primarily absorbed by evaporation of said liquid coolant at a temperature below said given temperature at which said protected liquid becomes hazardous.

21. An apparatus as defined in claim 20 wherein at least portions of one of said liquid conduit and said bayonet tube include thermally conductive fins affixed to said conduit or tube outer surface portion, said fins extending into the body of said protected liquid.

* * * * *